US008394564B2

(12) United States Patent
Jang et al.

(10) Patent No.: US 8,394,564 B2
(45) Date of Patent: Mar. 12, 2013

(54) POLYMERIZED TONER AND METHOD OF PRODUCING THE SAME

(75) Inventors: Wook Jang, Daejeon (KR); Chang Soon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 521 days.

(21) Appl. No.: 12/611,342

(22) Filed: Nov. 3, 2009

(65) Prior Publication Data

US 2010/0112472 A1 May 6, 2010

(30) Foreign Application Priority Data

Nov. 3, 2008 (KR) ..... 10-2008-0108220

(51) Int. Cl.
*G03G 9/00* (2006.01)

(52) U.S. Cl. ..... 430/108.11; 430/108.1; 430/108.8; 430/110.2

(58) Field of Classification Search ..... 430/108.1, 430/108.11, 108.8, 110.2
See application file for complete search history.

(56) References Cited

U.S. PATENT DOCUMENTS

| | | | | |
|---|---|---|---|---|
| 2006/0068311 | A1 | 3/2006 | Kim | |
| 2006/0127787 | A1 * | 6/2006 | Lee et al. | 430/108.3 |
| 2006/0160008 | A1 | 7/2006 | Lee et al. | |
| 2006/0276577 | A1 * | 12/2006 | Lee et al. | 524/403 |

FOREIGN PATENT DOCUMENTS

| | | | |
|---|---|---|---|
| CN | 1774669 | A | 5/2006 |
| CN | 101097411 | | 1/2008 |
| JP | 11-133658 | A | 5/1999 |
| KR | 10-2006-0083898 | A | 7/2006 |

OTHER PUBLICATIONS

Chinese Office Action issued in CN Appln. No: 200910207433.3 on Sep. 1, 2011 with English translation, 13 pages.

* cited by examiner

*Primary Examiner* — Thorl Chea
(74) *Attorney, Agent, or Firm* — Rothwell, Figg, Ernst & Manbeck, P.C.

(57) ABSTRACT

A polymerized toner is provided. The polymerized toner has cores containing polyvinylidene fluoride particles. The polyvinylidene fluoride particles have an average particle diameter of 1.1 to 1.5 μm and a melting temperature ($T_m$) of 140 to 160° C. The polyvinylidene fluoride particles are distributed at a higher concentration near the surface of the cores. This distribution improves the affinity of the cores for silica as an external additive to achieve an increased amount of surface charge and improved transfer efficiency of the polymerized toner. Further provided is a method of producing the polymerized toner.

10 Claims, No Drawings

POLYMERIZED TONER AND METHOD OF PRODUCING THE SAME

CROSS REFERENCE TO RELATED APPLICATIONS

This application claims priority from Korean Patent Application No. 10-2008-0108220 filed Nov. 3, 2008, which is incorporated herein in its entirety.

BACKGROUND OF THE INVENTION

1. Field of the Invention

The present invention relates to a polymerized toner and a method of producing the polymerized toner. More specifically, the present invention relates to a polymerized toner whose cores contain polyvinylidene fluoride (PVDF) particles to achieve an increased amount of surface charge and improved transfer efficiency, and a method of producing the polymerized toner.

2. Description of the Related Art

Toners are used for the development of electrophotographic images and in electrostatic printers, copiers, etc. Toners refer to coating substances that can be transferred and fixed to substrates to form desired patterns on the substrates. As computer-aided documentation has been generalized in recent years, there has been a rapidly increasing demand for image forming apparatuses, such as printers. In response to this demand, the use of toners is also on the rise.

Methods for the production of toners are largely classified into two types, i.e. methods based on pulverization and polymerization. The first type of methods based on pulverization is most widely known. According to a typical toner production method based on pulverization, a resin and a pigment are melt-mixed (or extruded), pulverized and classified to obtain toner particles. However, the toner particles have a broad particle diameter distribution and are very irregular in shape (e.g., sharp-edged), which are disadvantageous in terms of charging characteristics and flowability.

To overcome the above disadvantages of the first type of methods, the second type of methods for the production of spherical toner particles based on polymerization has been proposed. It is known that the second type of methods can be carried out by emulsion polymerization/aggregation and suspension polymerization. According to emulsion polymerization, the size distribution of particles is difficult to control and the reproducibility of toner quality remains problematic. For these reasons, suspension polymerization is employed in preference to emulsion polymerization.

A portion of a toner is transferred from a drum to paper during printing and the other portion of the toner remains untransferred in the drum. At this time, the toner optionally migrating from a feeder to the drum is required to be transferred to the paper as much as possible in order to achieve a maximum image concentration relative to the amount of the toner consumed without leaving any background contamination on the images. That is, an important task in the toner is to increase the efficiency of the toner to be transferred (i.e. transfer efficiency) to the paper.

SUMMARY OF THE INVENTION

The present invention has been made in an effort to solve the above problems, and it is an object of the present invention to provide a polymerized toner whose cores contain polyvinylidene fluoride particles having an average particle diameter of 1.1 to 1.5 μm and a melting temperature ($T_m$) of 140 to 160° C. to achieve high affinity for an external additive, an increased amount of surface charge and improved transfer efficiency.

It is another object of the present invention to provide a method of producing the polymerized toner.

In accordance with one aspect of the present invention, there is provided a polymerized toner whose cores contain polyvinylidene fluoride particles having an average particle diameter of 1.1 to 1.5 μm.

In an embodiment, the polyvinylidene fluoride particles have a melting temperature (Tm) of 140 to 160° C.

In an embodiment, the polymerized toner cores are prepared by polymerization of a monomer mixture including a polyvinylidene fluoride, one or more binder resin monomers and a charge control agent.

In an embodiment, the binder resin monomers are selected from the group consisting of a vinyl aromatic monomer, an acrylic monomer, a methacrylic monomer and a diene monomer.

In an embodiment, the binder resin monomers further include an acidic or basic olefin monomer.

In an embodiment, the charge control agent is a nigrosine type acidic dye, a higher aliphatic metal salt, an alkoxyamine, a chelate, a quaternary ammonium salt, an alkylamide, a fluorinated activator, a metal salt of naphthenic acid, an acidic organic complex, chlorinated paraffin, a chlorinated polyester, a polyester having acid groups, a sulfonylamine of copper phthalocyanine, a styrene-acrylic polymer having sulfonic acid groups or a mixture thereof.

In an embodiment, the monomer mixture further includes at least one additive selected from the group consisting of a wax, a crosslinking agent, a molecular weight modifier and a reaction initiator.

In an embodiment, the wax is a paraffin wax, a microcrystalline wax, a ceresin wax, a carnauba wax, an ester wax, a polyethylene wax, a polypropylene wax or a mixture thereof.

In an embodiment, the crosslinking agent is divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine, tetraallyloxyethane or a mixture thereof.

In an embodiment, the molecular weight modifier is t-dodecyl mercaptan, n-dodecyl mercaptan, n-octyl mercaptan, carbon tetrachloride, carbon tetrabromide or a mixture thereof.

In an embodiment, the polymerized toner comprises 60 to 95 parts by weight of the binder resin monomers, 0.1 to 30 parts by weight of the wax, 0.001 to 10 parts by weight of the crosslinking agent, 0.1 to 20 parts by weight of the charge control agent, 0.001 to 8 parts by weight of the molecular weight modifier, 0.01 to 5 parts by weight of the reaction initiator, and 1 to 5 parts by weight of the polyvinylidene fluoride.

In accordance with another aspect of the present invention, there is provided a method of producing a polymerized toner, comprising mixing a dispersion stabilizer with water to prepare an aqueous dispersion, dispersing a monomer mixture including a polyvinylidene fluoride, binder resin monomers and a charge control agent in the aqueous dispersion to homogenize the monomer mixture in the form of fine droplets, polymerizing the homogenized monomer mixture to prepare polymerized toner cores, washing and drying the polymerized toner cores, and coating the polymerized toner cores with an external additive.

In an embodiment, the aqueous dispersion is prepared by mixing 1 to 10 parts by weight of the dispersion stabilizer with 100 parts by weight of the water.

In an embodiment, the dispersion stabilizer is a water-soluble polyvinyl alcohol (PVA) having a degree of polymerization of 1,500 to 2,500 and a degree of saponification of 75 to 98%.

DETAILED DESCRIPTION OF THE INVENTION

Exemplary embodiments of the present invention will now be described in detail.

The present invention provides a polymerized toner that is produced by mixing a monomer mixture including polyvinylidene fluoride particles with an aqueous dispersion containing a dispersion stabilizer in water to homogenize the monomer mixture, polymerizing the homogenized monomer mixture to prepare polymerized toner cores, and washing and drying the polymerized toner cores.

The monomer mixture includes a polyvinylidene fluoride, binder resin monomers and a charge control agent. The monomer mixture further includes at least one additive selected from the group consisting of a wax, a crosslinking agent, a molecular weight modifier and a reaction initiator.

As the binder resin monomers, there can be used one or more monomers selected from the group consisting of a vinyl aromatic monomer, an acrylic monomer, a methacrylic monomer and a diene monomer. Optionally, the binder resin monomers may further include an acidic or basic olefin monomer.

The vinyl aromatic monomer is selected from the group consisting of styrene, monochlorostyrene, methylstyrene, and dimethylstyrene. It is preferred to use the vinyl aromatic monomer in an amount of 30 to 90 parts by weight, based on 100 parts by weight of all the binder resin monomers.

The acrylic monomer is selected from the group consisting of methyl acrylate, ethyl acrylate, n-butyl acrylate, isobutyl acrylate, dodecyl acrylate and 2-ethylhexyl acrylate. The methacrylic monomer is selected from the group consisting of methyl methacrylate, ethyl methacrylate, n-butyl methacrylate, isobutyl methacrylate, dodecyl methacrylate and 2-ethylhexyl methacrylate. The diene monomer is selected from the group consisting of butadiene and isoprene.

At least one monomer selected from the acrylic monomer, the methacrylic monomer and the diene monomer is preferably used in an amount of 5 to 70 parts by weight, based on 100 parts by weight of all the binder resin monomers.

The acidic olefin monomer may be an $\alpha,\beta$-ethylenically unsaturated compound having at least one carboxyl group. The basic olefin monomer may be a methacrylic acid ester, methacrylamide, vinylamine or diallyl amine of an aliphatic alcohol having at least one amine group or quaternary ammonium group, or an ammonium salt thereof. The acidic and/or basic olefin monomer is preferably used in an amount of 0.1 to 30 parts by weight, based on 100 parts by weight of all the binder resin monomers.

0.01 to 10 parts by weight of at least one polar polymer selected from polyesters and styrene-acrylic polymers may be added to 100 parts by weight of the binder resin monomers.

The binder resin monomers are preferably present in an amount of 60 to 95 parts by weight, based on the total weight of the polymerized toner.

As the charge control agent, there can be used: a cationic charge control agent, such as a nigrosine type acidic dye, a higher aliphatic metal salt, an alkoxyamine, a chelate, a quaternary ammonium salt, an alkylamide, a fluorinated activator or a metal salt of naphthenic acid; an anionic charge control agent, such as an acidic organic complex, chlorinated paraffin, a chlorinated polyester, a polyester containing an excess of acid groups, a sulfonylamine of copper phthalocyanine or a styrene-acrylic polymer having sulfonic acid groups; or a mixture thereof. It is preferred to use the charge control agent in an amount of 0.1 to 20 parts by weight, based on 100 parts by weight of the monomer mixture.

1 to 5 parts by weight of polyvinylidene fluoride particles having an average particle diameter of 1.1 to 1.5 μm and a melting temperature ($T_m$) of 140 to 160° C. are added to 100 parts by weight of the monomer mixture.

The polyvinylidene fluoride particles are distributed at a higher concentration near the surface of the toner cores. This distribution improves the affinity of the toner cores for silica as an external additive and enables the external additive to be efficiently fixed to the toner cores. Hydrophobic modification lowers the surface tension of silica as the external additive. Since the polyvinylidene fluoride particles distributed at a higher concentration near the surface of the toner cores are hydrophobic and have a low surface tension, the affinity of the toner cores for the hydrophobically modified silica can be improved. The polyvinylidene fluoride particles also act to increase the amount of charge of the polymerized toner.

If the polyvinylidene fluoride particles have an average particle diameter smaller than 1.1 μm, a sufficient amount of surface charge of the polymerized toner is not obtained although most of the polyvinylidene fluoride particles are located near the surface of the toner. Meanwhile, if the polyvinylidene fluoride particles have an average particle diameter larger than 1.5 μm, most of the polyvinylidene fluoride particles are not located near the surface of the toner particles. Therefore, the average particle diameter of the polyvinylidene fluoride particles is limited to the range of 1.1 to 1.5 μm. The use of the polyvinylidene fluoride particles in an amount of less than 1 part by weight results in little increase in the amount of charge of the toner. Meanwhile, the use of the polyvinylidene fluoride particles in an amount of more than 5 parts by weight undesirably deteriorates the stability of the monomer mixture during polymerization.

The monomer mixture may further include at least one additive selected from the group consisting of a wax, a crosslinking agent, a molecular weight modifier and a reaction initiator.

The wax may be selected from the group consisting of: petroleum waxes, including paraffin wax, microcrystalline wax and ceresin waxes; natural waxes, including carnauba wax; synthetic waxes, including polyester wax, polyethylene wax and polypropylene wax; and mixtures thereof. It is preferred to use the wax in an amount of 0.1 to 30 parts by weight, based on 100 parts by weight of the monomer mixture.

The crosslinking agent may be divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine or tetraallyloxyethane. It is preferred to use the crosslinking agent in an amount of 0.001 to 10 parts by weight, based on 100 parts by weight of the monomer mixture.

The molecular weight modifier may be selected from the group consisting of t-dodecyl mercaptan, n-dodecyl mercaptan, n-octyl mercaptan, carbon tetrachloride, carbon tetrabromide and mixtures thereof. It is preferred to use the molecular weight modifier in an amount of 0.001 to 8.000 parts by weight, based on 100 parts by weight of the monomer mixture.

The reaction initiator may be an oil-soluble or water-soluble initiator. Specific examples of the reaction initiator include: azo initiators, such as azobisisobutyronitrile and azobisvaleronitrile; organic peroxides, such as benzoyl peroxide and lauroyl peroxide; and generally used water-soluble initiators, such as potassium persulfate and ammonium persulfate. The reaction initiator is preferably used in an amount of 0.01 to 5.00 parts by weight and more preferably 0.1 to 2.0 parts by weight, based on 100 parts by weight of the monomer mixture.

The polymerized toner cores are coated with an external additive.

Particulate silica is used as the external additive. The silica particles may be used without being modified. Preferably, the silica particles are hydrophobically modified. The hydrophobic modification lowers the surface tension of the silica particles. The silica is used in an amount of 1 to 5 parts by weight, based on 100 parts by weight of the polymerized toner cores. The external additive is coated on the surface of the polymerized toner cores with stirring at a high speed.

The polymerized toner cores are prepared by mixing the monomer mixture with an aqueous dispersion containing a dispersion stabilizer in water to homogenize the monomer mixture, and polymerizing the homogenized monomer mixture.

A polyvinyl alcohol (PVA) is preferred as the dispersion stabilizer. The polyvinyl alcohol (PVA) has a degree of polymerization of 1,500 to 2,500 and preferably 1,700 to 2,100. The polyvinyl alcohol (PVA) has a degree of saponification of 75 to 98% and preferably 85 to 95%. If the polyvinyl alcohol (PVA) has a degree of polymerization lower than 1,500, it is difficult to sufficiently disperse the monomer mixture in the aqueous dispersion. Meanwhile, if the polyvinyl alcohol (PVA) has a degree of polymerization exceeding 2,500, it is difficult to make the aqueous dispersion uniform due to the low water solubility of the polyvinyl alcohol. The polyvinyl alcohol (PVA) having a degree of saponification of less than 75% tends to precipitate in the water due to its low solubility when the reaction temperature is increased to 60 to 90° C. This precipitation makes it impossible to appropriately disperse the monomer mixture in the aqueous dispersion. Meanwhile, the polyvinyl alcohol (PVA) having a degree of saponification exceeding 98% is disadvantageous as a dispersant in terms of performance due to its high hydrophilicity. The dispersion stabilizer is present in an amount of 1 to 10 parts by weight, based on 100 parts by weight of the aqueous dispersion.

The present invention also provides a method of producing a polymerized toner. The method of the present invention comprises mixing a dispersion stabilizer with water to prepare an aqueous dispersion, dispersing a monomer mixture including a polyvinylidene fluoride, binder resin monomers and a charge control agent in the aqueous dispersion to homogenize the monomer mixture in the form of fine droplets, polymerizing the homogenized monomer mixture to prepare polymerized toner cores, washing and drying the polymerized toner cores, and coating the polymerized toner cores with an external additive.

Hereinafter, the individual steps of the method according to the present invention will be explained in detail.

(1) Preparation of Polymerized Toner Cores

First, a water-soluble polyvinyl alcohol (PVA) as a dispersion stabilizer is dispersed in water to prepare an aqueous dispersion. A monomer mixture including a polyvinylidene fluoride is homogenized in the aqueous dispersion while applying a shear force using a homogenizer, followed by polymerization to prepare toner cores.

The monomer mixture includes one or more binder resin monomers selected from the group consisting of a vinyl aromatic monomer, an acrylic monomer, a methacrylic monomer and a diene monomer. Optionally, the binder resin monomers may further include an acidic or basic olefin monomer.

(2) Removal of the Dispersion Stabilizer (Polyvinyl Alcohol (PVA)) and Drying

In this step, the polyvinyl alcohol (PVA) is separated from the solution containing the polymerized toner cores by a suitable method. First, the aqueous dispersion containing the polyvinyl alcohol (PVA) and the polymerized toner cores is diluted with a two-fold amount of distilled water. A homogenizer is used to apply a shear force to the dilute aqueous solution, followed by separation and cleaning using a suitable apparatus, such as a filter, a filter press, a general centrifuge or a continuous decanter type high-speed centrifuge, to separate the polyvinyl alcohol from the toner cores. Filtration is conducted to remove moisture, leaving the toner cores in the form of a cake. The cake is dried in a vacuum oven at room temperature.

(3) Coating with External Additive

Silica as an external additive is added to the polymerized toner cores, and the resulting mixture is stirred using a Henschel mixer at a high speed of 5,000 rpm for 7 min to coat the external additive on the surface of the polymerized toner cores.

Hereinafter, the present invention will be explained in more detail with reference to the following examples. However, these examples serve to provide further appreciation and disclosure of the invention but are not meant in any way to restrict the scope of the invention.

EXAMPLES

Example 1

Preparation of Polymerized Toner Cores

5 Parts by weight of a water-soluble polyvinyl alcohol (degree of polymerization=1,700, degree of saponification=90%) as a dispersion stabilizer was added to 400 parts by weight of ion-exchange water. After the mixture was stirred at room temperature for 10 min, the temperature was raised to 70° C., which is a reaction temperature. The mixture was further stirred for 20 min to prepare an aqueous dispersion.

160 Parts by weight of styrene, 36 parts by weight of n-butyl acrylate and 4 parts by weight of acrylic acid as binder resin monomers, 4 parts by weight of allyl methacrylate as a crosslinking agent and 0.4 parts by weight of n-dodecyl mercaptan as a molecular weight modifier were mixed together. One part by weight of a styrene-acrylic polymer having sulfonic acid groups as a charge control agent was sufficiently dissolved in the mixture and 10 parts by weight of a pigment was added thereto. After the resulting mixture was stirred in a bead mill at 2,000 rpm for 2 hr, the beads were removed to prepare 215.4 parts by weight of the mixture of the monomers and the pigment.

The mixture thus prepared was heated to 70° C. in a water bath. Then, 5 parts by weight of paraffin wax and 3 parts by weight of polyvinylidene fluoride particles having an average particle diameter of 1.3 μm and a melting temperature ($T_m$) of 150° C. were added, followed by stirring 20 min to prepare a monomer mixture. The monomer mixture was homogenized in the aqueous dispersion using a homogenizer at a speed of 13,000 rpm to disperse the monomer mixture in the form of fine droplets. Thereafter, the monomer mixture was allowed to react with stirring using a paddle stirrer at 200 rpm for 15 min to prepare polymerized toner cores.

(Centrifugal Cleaning)

The aqueous dispersion containing the polymerized toner cores was diluted with a two-fold amount of distilled water. A shear force was applied to the dilute aqueous solution using a homogenizer, followed by centrifugation in a centrifuge (Beckman J2-21M, Rotor JA-14) at 3,000 rpm for 15 min to obtain a concentrate containing the polymerized toner cores. The concentrate was diluted with a two-fold amount of distilled water. A shear force was applied to the dilute aqueous solution using a homogenizer, followed by centrifugation in a centrifuge (Beckman J2-21M, Rotor JA-14) at 3,000 rpm for 15 min. The above procedure was further repeated twice to remove the polyvinyl alcohol (PVA) from the surface of the toner cores. Filtration was conducted to remove moisture, leaving a cake of the toner cores. The cake was dried in a vacuum oven at room temperature for 48 hr. The polymerized toner cores had a volume average particle diameter of 7 μm and a ratio of volume average particle diameter to number average particle diameter of 1.26.

(Coating with External Additive)

2 Parts by weight of silica as an external additive was added to 100 parts by weight of the polymerized toner core. The mixture was stirred using a Henschel mixer at a high speed of 5,000 rpm for 7 min to coat the external additive on the surface of the polymerized toner cores.

Example 2

A polymerized toner was produced in the same manner as in Example 1, except that polyvinylidene fluoride particles were used in an amount of 4 parts by weight. The results of evaluations of the polymerized toner are shown in Table 1.

Example 3

A polymerized toner was produced in the same manner as in Example 1, except that polyvinylidene fluoride particles having an average particle diameter of 1.5 μm was used. The results of evaluations of the polymerized toner are shown in Table 1.

Example 4

A polymerized toner was produced in the same manner as in Example 1, except that polyvinylidene fluoride particles having a melting temperature ($T_m$) of 140° C. was used. The results of evaluations of the polymerized toner are shown in Table 1.

Comparative Example 1

A polymerized toner was produced in the same manner as in Example 1, except that polyvinylidene fluoride particles were not added. The results of evaluations of the polymerized toner are shown in Table 1.

Comparative Example 2

A polymerized toner was produced in the same manner as in Example 1, except that polyvinylidene fluoride particles having an average particle diameter of 2 μm was used. The results of evaluations of the polymerized toner are shown in Table 1.

Comparative Example 3

A polymerized toner was produced in the same manner as in Example 1, except that polyvinylidene fluoride particles were used in an amount of 10 parts by weight. The results of evaluations of the polymerized toner are shown in Table 1.

Experimental Example 1

Amounts of Surface Charge (Q/m) of the Toners

Each of the toners was collected from a sleeve roll of a cartridge. The amount of surface charge (Q/m) of the toner was measured using a Q/m meter (210HS-2B, Trek).

(Consumed Amounts and Transfer Efficiency of the Toners)

Each of the surface-treated toners was filled in a feeder of a printer cartridge (HP4600 Printer, Hewlett-Packard). The feeder filled with the toner was weighed before printing. Rectangles of 19 cm (w)×1.5 cm (l) were printed on 1,000 sheets of paper (A4 size). After completion of the printing, the feeder was weighed. The amount of the toner consumed was calculated by the following equation:

Amount of toner consumed(g)=Weight of feeder before printing−Weight of feeder after printing on 1,000 sheets of paper The weight of a drum separable from the feeder was measured before and after printing. The amount of the toner wasted without being transferred to the paper was calculated by the following equation:

Amount of toner wasted(g)=Weight of drum after printing on 1,000 sheets of paper−Weight of drum before printing The transfer efficiency of the toner was calculated by the following equation:

$$\text{Transfer efficiency of toner}(\%) = \frac{\text{Amount of toner consumed} - \text{Amount of toner wasted}}{\text{Amount of toner consumed}} \times 100$$

The results are shown in Table 1.

TABLE 1

| | Polyvinylidene fluoride | | | | |
|---|---|---|---|---|---|
| | Average particle diameter (μm) | Content (parts by weight) | $T_m$ (° C.) | Amount of surface charge of toner, Q/m (C/g) | Transfer efficiency (%) |
| Example 1 | 1.3 | 3 | 150 | −14 | 98 |
| Example 2 | 1.3 | 4 | 150 | −16 | 98 |
| Example 3 | 1.5 | 3 | 150 | −13 | 98 |
| Example 4 | 1.3 | 3 | 140 | −15 | 98 |
| Comparative Example 1 | — | — | — | −12 | 95 |
| Comparative Example 2 | 2 | 3 | 150 | −10 | 90 |

TABLE 1-continued

| | Polyvinylidene fluoride | | | | |
|---|---|---|---|---|---|
| | Average particle diameter (μm) | Content (parts by weight) | $T_m$ (° C.) | Amount of surface charge of toner, Q/m (C/g) | Transfer efficiency (%) |
| Comparative Example 3 | 1.3 | 10 | 150 | −15 | 80 |

As can be seen from the results in Table 1, the polymerized toners of Examples 1-4, each of which comprises polyvinylidene fluoride particles within the particle diameter and content ranges defined above, showed a high transfer efficiency and an increased amount of charge, compared to the polymerized toners of Comparative Examples 1-3.

As is apparent from the foregoing, the presence of polyvinylidene fluoride particles having an average particle diameter of 1.1 to 1.5 μm and a melting temperature ($T_m$) of 140 to 160° C. in the polymerized toner cores increases the amount of charge of the toner surface and improves the transfer efficiency of the toner.

What is claimed is:

1. A polymerized toner comprising cores, wherein the cores comprise polyvinylidene fluoride particles having an average particle diameter of 1.1 to 1.5 μm, wherein the core is prepared by polymerization of a monomer mixture comprising a polyvinylidene fluoride, one or more binder resin monomer(s) and a charge control agent, and wherein the monomer mixture comprises 1 to 5 parts by weight of the polyvinylidene fluoride, 60 to 95 parts by weight of binder resin monomer, and 0.1 to 20 parts by weight of the charge control agent.

2. The polymerized toner of claim 1, wherein the polyvinylidene fluoride particles have a melting temperature ($T_m$) of 140 to 160° C.

3. The polymerized toner of claim 1, wherein the binder resin monomer is at least one selected from the group consisting of a vinyl aromatic monomer, an acrylic monomer, a methacrylic monomer and a diene monomer.

4. The polymerized toner of claim 3, wherein the binder resin monomer further comprises an acidic or basic olefin monomer.

5. The polymerized toner of claim 1, wherein the charge control agent is at least one selected from the group consisting of a nigrosine type acidic dye, a higher aliphatic metal salt, an alkoxyamine, a chelate, a quaternary ammonium salt, an alkylamide, a fluorinated activator, a metal salt of naphthenic acid, an acidic organic complex, chlorinated paraffin, a chlorinated polyester, a polyester having acid groups, a sulfonylamine of copper phthalocyanine, a styrene-acrylic polymer having sulfonic acid groups and a mixture thereof.

6. The polymerized toner of claim 1, wherein the monomer mixture further comprises at least one additive selected from the group consisting of a wax, a crosslinking agent, a molecular weight modifier and a reaction initiator.

7. The polymerized toner of claim 6, wherein the wax is at least one selected from the group consisting of a paraffin wax, a microcrystalline wax, a ceresin wax, a carnauba wax, an ester wax, a polyethylene wax, a polypropylene wax and a mixture thereof.

8. The polymerized toner of claim 6, wherein the crosslinking agent is at least one selected from the group consisting of divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine, tetraallyloxyethane and a mixture thereof.

9. The polymerized toner of claim 6, wherein the molecular weight modifier is at least one selected from the group consisting of t-dodecyl mercaptan, n-dodecyl mercaptan, n-octyl mercaptan, carbon tetrachloride, carbon tetrabromide and a mixture thereof.

10. The polymerized toner of claim 6, wherein the polymerized toner comprises 60 to 95 parts by weight of the binder resin monomer, 0.1 to 30 parts by weight of the wax, 0.001 to 10 parts by weight of the crosslinking agent, 0.1 to 20 parts by weight of the charge control agent, 0.001 to 8 parts by weight of the molecular weight modifier, 0.01 to 5 parts by weight of the reaction initiator, and 1 to 5 parts by weight of the polyvinylidene fluoride.

* * * * *